US008267643B2

(12) United States Patent
Wagner et al.

(10) Patent No.: US 8,267,643 B2
(45) Date of Patent: Sep. 18, 2012

(54) PUMP WITH CUTTING IMPELLER AND PRE-CUTTER

(75) Inventors: Peter Wagner, Werdohl (DE); Dirk Wenderott, Castrop-Rauxel (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 620 days.

(21) Appl. No.: 12/496,134

(22) Filed: Jul. 1, 2009

(65) Prior Publication Data

US 2010/0003124 A1 Jan. 7, 2010

(30) Foreign Application Priority Data

Jul. 5, 2008 (DE) ..... 10 2008 031 842

(51) Int. Cl.
*F04D 29/18* (2006.01)

(52) U.S. Cl. ..... 415/121.1; 415/121.2; 415/205; 415/216.1; 415/198.1; 415/206; 416/174; 416/198 R; 416/223 R

(58) Field of Classification Search ..... 415/121.1, 415/121.2, 205, 216.1, 198.1, 206; 416/175, 416/198 R, 223 R
See application file for complete search history.

(56) References Cited

U.S. PATENT DOCUMENTS

| | | | | |
|---|---|---|---|---|
| 3,560,106 | A * | 2/1971 | Sahlstrom | 415/204 |
| 4,108,386 | A * | 8/1978 | Conery et al. | 241/46.11 |
| 4,402,648 | A * | 9/1983 | Kretschmer | 415/121.1 |
| 4,640,666 | A * | 2/1987 | Sodergard | 415/121.1 |
| 4,911,368 | A * | 3/1990 | Nishimori | 241/46.017 |
| 5,016,825 | A * | 5/1991 | Carpenter | 415/121.1 |
| 5,460,483 | A | 10/1995 | Dorsch | |
| 6,224,331 | B1 | 5/2001 | Hayward et al. | |
| 6,951,445 | B2 * | 10/2005 | Burgess | 415/121.1 |
| 7,159,806 | B1 * | 1/2007 | Ritsema | 415/121.1 |
| 2008/0152481 | A1 | 6/2008 | Wagner | |
| 2009/0092479 | A1 | 4/2009 | Wagner | |

FOREIGN PATENT DOCUMENTS

| | | | |
|---|---|---|---|
| DE | 102004058458 | B3 | 5/2006 |
| DE | 102005014348 | B3 | 8/2006 |
| JP | 4-219490 | A | 8/1992 |
| JP | 2003-083275 | A | 3/2003 |

* cited by examiner

*Primary Examiner* — Igor Kershteyn
(74) *Attorney, Agent, or Firm* — Richard M. Goldberg

(57) ABSTRACT

A pump includes a cutting impeller (38) and a pre-chopper (50) driven by a shaft portion (46) that projects axially from the cutting impeller (38), with the pre-chopper (50) being surrounded by an intake port (22) of the pump, the intake port having, at least on a part of its length, in the vicinity of the pre-chopper, a non-circular internal cross-section.

6 Claims, 4 Drawing Sheets

PUMP WITH CUTTING IMPELLER AND PRE-CUTTER

BACKGROUND OF THE INVENTION

The invention relates to a pump having a cutting impeller and a pre-cutter driven by a shaft portion that axially projects from the cutting impeller.

A pump of this type is known from DE 10 2005 014 348 B3 and is used for example in machine tools for circulating lubricating coolant emulsions that are contaminated with metal chippings. This pump is a centrifugal pump that is additionally provided with an axial impeller disposed upstream of a radial impeller, said axial impeller being configured as a cutting impeller and having, at its upstream end, cutting edges that cooperate with stationary counter blades arranged radially in a suction passage, so that chippings and other contaminants that have been sucked in are cut-off and chopped. The pre-cutter serves for chopping coarse contaminants before they are sucked-in by the axial impeller and are then chopped further.

SUMMARY OF THE INVENTION

It is an object of the invention to provide a pump of the type indicated above, wherein the chopping properties are further improved. According to the invention, this object is achieved by the feature that the pre-chopper is surrounded by an intake port of the pump, which intake port has, at least on a part of its length close to the pre-chopper, a non-circular internal cross-section.

The chippings that are produced in machine tools typically have a helical shape and have a tendency to cling together and to form relatively complex clews which are difficult to be sucked-in and chopped. The pre-chopper of the pump has the task, to resolve these clews or at least to loosen them to such an extent that the chippings are transported into the range of the cutting impeller and can be chopped there. It has turned out that the features according to the invention provide a significant improvement in the efficiency of the pre-chopper.

At first, the surrounding intake port is effective to concentrate the current and thereby to ensure that the clews of chippings are drawn into the range of the pre-chopper more efficiently.

The rotating pre-chopper induces a rotation of the chipping clews, so that the latter move circumferentially along the internal wall of the intake port. Since this wall has a non-circular cross-section, the passageway for the chippings revolving between the pre-chopper and the internal wall of the intake port becomes broader and narrower in an alternating way. It has been shown that this is very favorable for resolving the chipping clews which can then readily be conveyed towards the cutting impeller and can finally be chopped there.

Moreover, the intake port forms a protector against accidental contact, which permits to install the pump in a lubricating coolant reservoir in a position, e.g. horizontally, in which the intake portion is accessible for the personnel.

Useful embodiments and further developments of the invention are indicated in the dependent claims.

Preferably, the pre-chopper has the shape of a blade wheel with lugs projecting in axial direction, which lugs cause a strong swirl in the liquid that is being sucked-in and thus have the effect that the chipping clews revolve concurrently with the pre-chopper and move relative to the wall of the intake port with high velocity.

BRIEF DESCRIPTION OF THE DRAWINGS

An embodiment example will now be described in conjunction with the drawings, wherein.

DETAILED DESCRIPTION

Figure 1:
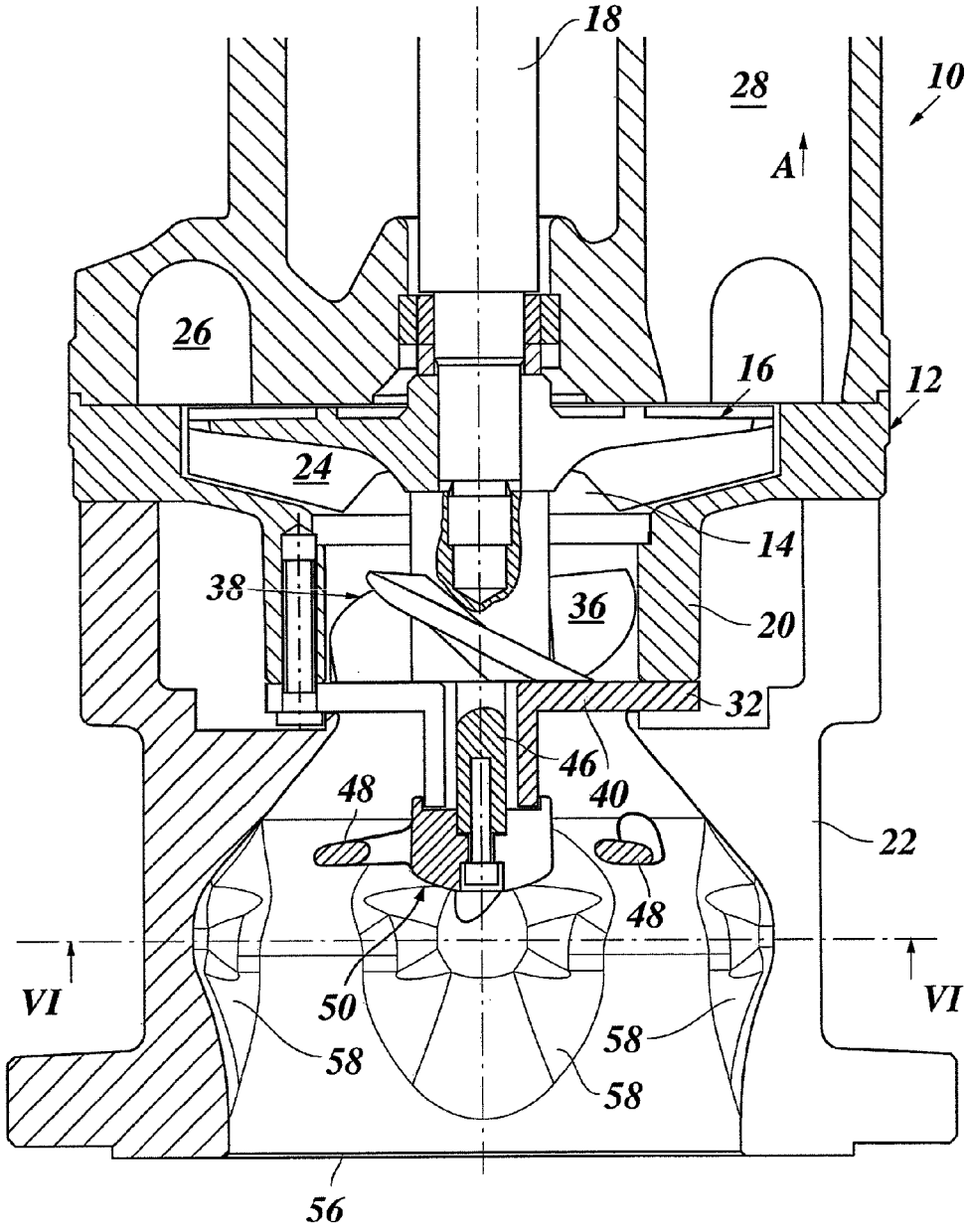
FIG. 1 is an axial cross-sectional view of a pump according to the invention.

The centrifugal pump shown in FIG. 1 has an essentially cylindrical casing with a head member 12 flanged to the lower end of the casing, and at least this head member 12 is immersed in a liquid reservoir (not shown) in a machine base of a machine tool. A pump chamber 14 accommodating a radial impeller 16 is formed inside of the head member 12. A shaft 18 is coaxially supported in the casing 10, and a top end thereof is connected to a drive motor (not shown) and is supported in stationary bearings that have not been shown. These bearings determine the axial position of the shaft 18. The radial impeller 16 is keyed onto the shaft 18. A wall of the head member 12, which wall forms the lower part of the pump chamber 14, is formed with a suction passage 20 projecting downwardly coaxially with the impeller 16 and the shaft 18, and an intake port 22 is axially adjoined thereto.

Figure 6:
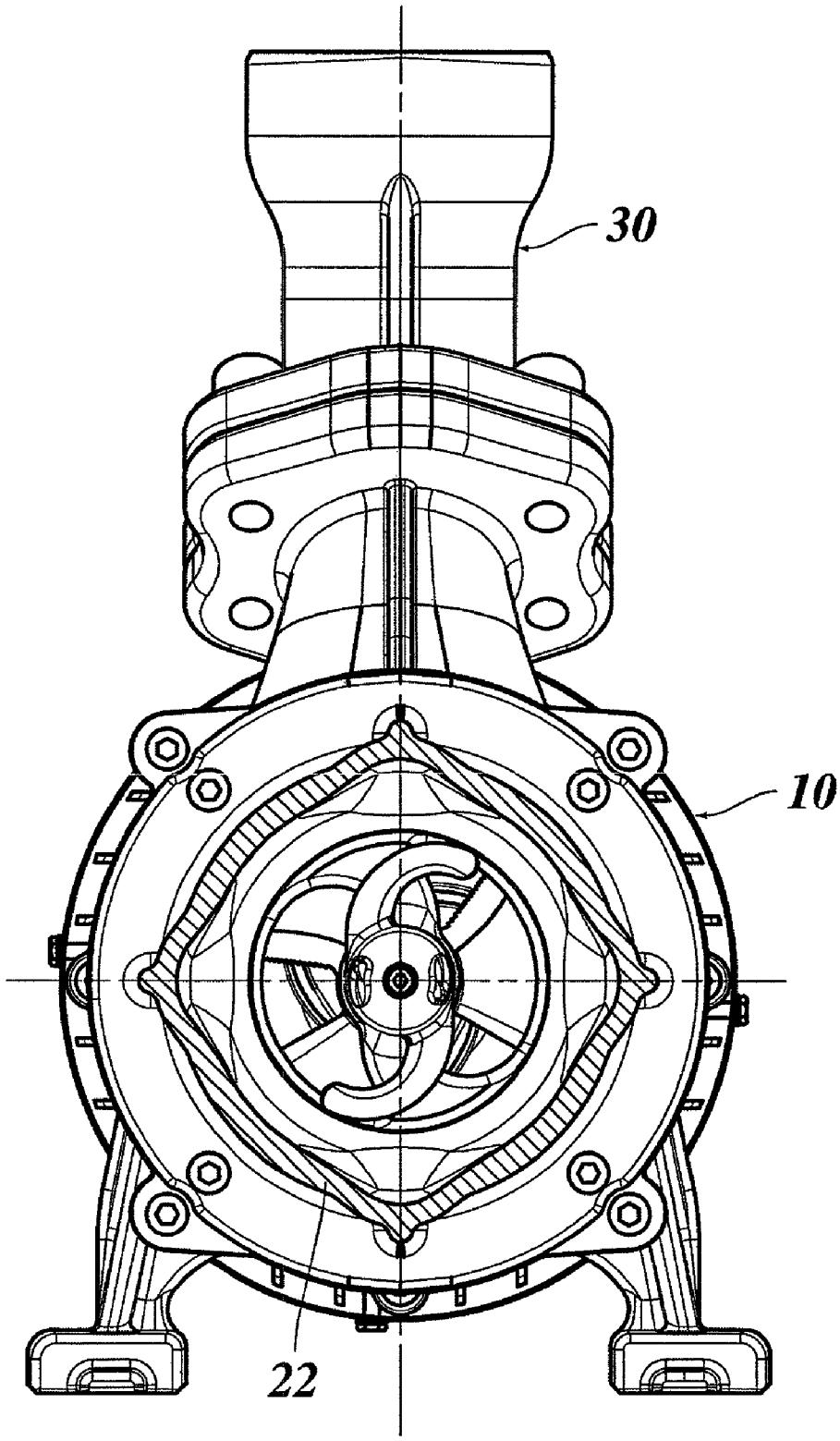
FIG. 6 is a cross-sectional view taken along the line VI-VI in FIG. 1.

The impeller is a semi-open impeller equipped with blades 24 that are open downwardly. These blades are inclined in such a manner that the liquid is sucked-in via the intake port 22 and the suction passage 20 and is then conveyed radially outwardly into an annular chamber 26 above the outer periphery of the pump chamber 14. As a result of the liquid pressure that is built up in the annular chamber 26 in this way, the liquid flows upwardly in direction of an arrow A through a rise passage 28 formed in the casing 10 towards a pump outlet port 30 that has not been shown in FIG. 1 (FIG. 6).

Figure 2:
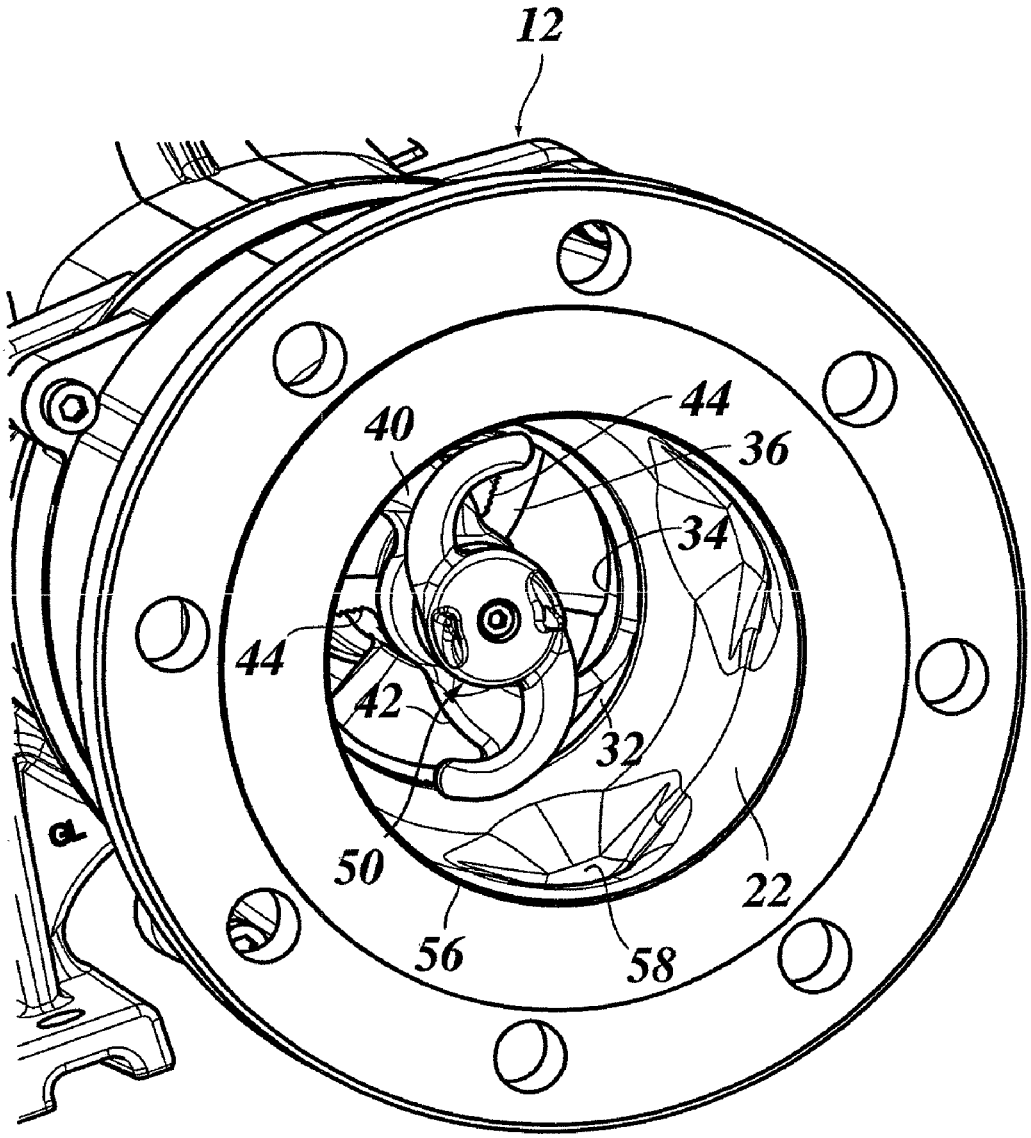
FIG. 2 is a perspective view of an intake portion of the pump.

An intake plate 32 is arranged at the lower end of the suction passage 20, said intake plate defining the bottom of the pump chamber 24 and having an intake opening 34 (FIG. 2).

A cutting impeller 38 configured as an axial impeller and equipped with helical blades 36 is mounted on the shaft 18 inside of the suction passage 20. The cutting impeller 38 conveys the liquid from the top end of the intake port 22 axially upwardly through the intake opening 34 into the interior of the pump chamber 14.

FIG. 2 shows the pump in a bottom view. Looking through the intake opening 34, one can see the blades 36 of the cutting impeller. The intake plate 32 forms two counter blades 40 projecting radially inwardly into the intake opening 34 and having cutting edges 42 that co-operate with toothed cutting edges 44 of the blades 36. The counter blades 40 are curved in a spiral shape, thereby deviating from the radial direction towards the direction of rotation of the impeller (in counter-clock direction in FIG. 2) when passing from the inside to the outside.

Since the cutting edges 44 of the cutting impeller extend in essentially radial direction, whereas the cutting edges 42 of the counter blades have a spiral shape, the cutting edges cooperate like scissors when the cutting impeller rotates. When the cutting edges meet each other, the scissors action proceeds essentially radially from the inside to the outside. In the outer part, however, the cutting edges 44 are curved in a direction opposite to the running direction of the cutting impeller 38.

The cutting edges 44 project radially outwardly beyond the radius of the intake opening 34, and the cutting edges 42 extend inwardly into the hub portion of the cutting impeller. Thus, each pair of cutting edges defines a window that becomes closed completely during a cutting action. In this way, chippings and other contaminants are chopped reliably.

In the range of the cutting edges, the blades 36 and the counter blades 40 are for example made of hardened steel having a Rockwell hardness of 60 HRC. The hardness and the axial distance between the cutting edges 42 and 44 has to be determined in accordance with the intended use of the pump. It is also possible that, in operation, the cutting surface of the cutting impeller slides on the intake plate 32. The axial distance between the cutting edges 42, 44 can be changed and adjusted by means of spacer sheets. For example, the spacer sheets are inserted from outside between the intake plate 32 and the head member 12, so that the distance between the intake plate and the cutting edges 44 is changed.

The toothed configuration of the cutting edges 44 of the blades 36 assures that chippings, if present, are caught and entrained by the teeth of the cutting edge, are held during the cutting operation and are then separated. This prevents the chippings from moving radially outwardly along the cutting edge 42. The teeth of the cutting edge 44 may have such a shape that each of them is oriented at right angles to the corresponding portion of the curved cutting edge 42 of the counter blade (not shown).

As an alternative or in addition, teeth may also be provided on the cutting edges 42 of the counter blades 40.

As can be seen in FIG. 1, the lower end of the shaft 18 is prolonged by a thinner shaft portion 46 that projects downwardly beyond the cutting impeller 38 into the intake port 22 and carries, at its lower end, a pre-chopper 50 equipped with two blades 48. In FIG. 1 the plane of the cross-section passes through one of the curved blades 48, so that the latter appears to be separated from the main part of the pre-chopper.

Figure 3:
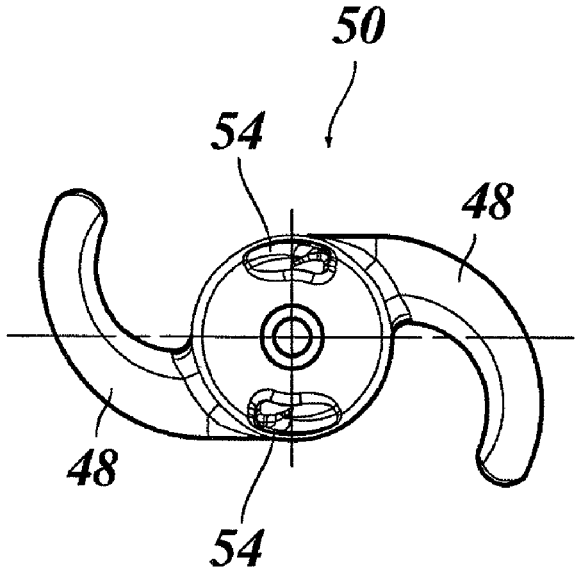
FIGS. 3-5 show different views of a pre-chopper.
Figure 4:
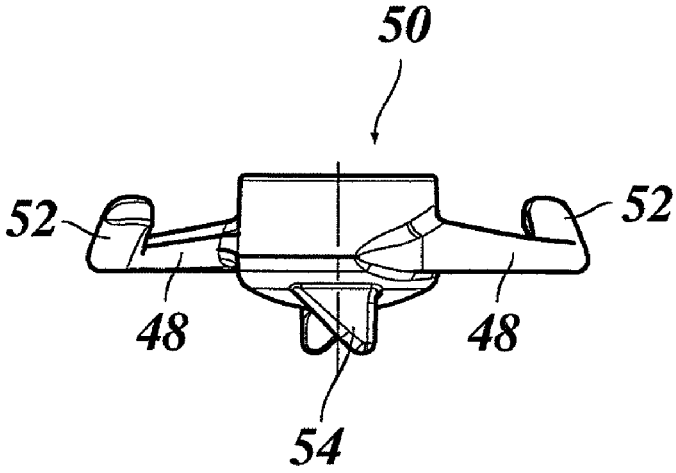
Figure 5:
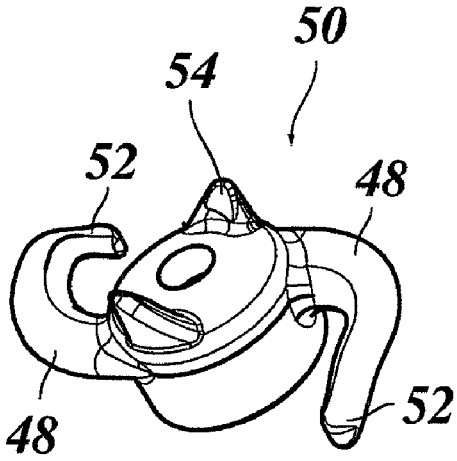

The pre-chopper 50 has been shown in greater detail in FIGS. 3 to 5. FIG. 3 shows the pre-chopper in an axial view. It can be seen that the blades 48, together, form the shape of an "S". As can be seen more clearly in FIGS. 4 and 5, the distal ends 52 of the blades are however angled away from the plane of the pre-chopper, such that the blades assist in the transport of the liquid medium towards the suction passage 20 like propellers. Moreover, the pre-chopper has, in the vicinity of its hub, two lugs 54 that project axially towards the mouth of the intake port 22.

This shape of the pre-chopper 50 has the effect that clews of chippings that are entrained in the liquid that is being sucked-in, are swirled efficiently, so that they rotate at high speed together with the pre-chopper and, consequently, move along the internal wall of the intake passage 20 in circumferential direction until they have finally passed the pre-chopper and enter into the suction passage 20 through the intake opening 34, where they are chopped further.

The shape of the internal wall of the intake port 22 has been illustrated in FIGS. 1, 2 and 6. While the internal cross-section of the intake port generally tapers in a funnel shape from a mouth 56 at the lower end in FIG. 1 towards the intake end of the suction passage 20, four pockets 58 are formed in the peripheral wall and distributed circumferentially with equal angular spacings, in a position approximately level with the pre-chopper 50 but slightly offset from the latter towards the outside, each of said pockets having the shape of a shallow, rounded-off pyramid.

As can be seen in the cross-sectional view in FIG. 6, this has the effect that, here, the intake port 22 has a non-circular, approximately square internal cross-section. As a result, the chipping clews that have been caused to revolve rapidly by the pre-chopper 50 are "crunched" at the internal wall of the intake port 22 and are resolved in this way before they reach the cutting impeller 38. Thus, the intake port serves as a stationary support which, together with the rotating pre-chopper, loosens and resolves the clews of chippings. Moreover, the intake port 22 serves as a protector that prevents that a person reaching with his or her hand into the intake range of the pump is hurt by the rotating pre-chopper. This permits to install the pump also in a horizontal posture, for example, as has been shown in FIG. 6.

The invention claimed is:

1. A pump comprising:

a cutting impeller, a pre-chopper, a shaft portion that drives the pre-chopper and cutting impeller and that projects axially from the cutting impeller, and an intake port that surrounds the pre-chopper, said intake port having, at least on a part of its length, in the vicinity of the pre-chopper, a non-circular internal cross-section, wherein the intake port includes an internal wall formed, approximately level with the pre-chopper, with four pockets which have approximately the shape of square truncated pyramids and give the intake port an approximately square internal cross-section.

2. The pump according to claim 1, wherein the pre-chopper has two blades which, together, form the shape of an "S" and are curved such that a convexly curved side thereof is ahead in a direction of rotation of the pre-chopper.

3. The pump according to claim 2, wherein distal ends of the blades are angled away from a plane of the pre-chopper.

4. The pump according to claim 1, wherein the pre-chopper has at least one axially projecting lug that is arranged eccentrically.

5. A pump comprising:

a cutting impeller, a pre-chopper, a shaft portion that drives the pre-chopper and cutting impeller and that projects axially from the cutting impeller, and an intake port that surrounds the pre-chopper, said intake port having, at least on a part of its length, in the vicinity of the pre-chopper, a non-circular internal cross-section, wherein the pre-chopper has two blades which, together, form the shape of an "S" and are curved such that a convexly curved side thereof is ahead in a direction of rotation of the pre-chopper, and wherein distal ends of the blades are angled away from a plane of the pre-chopper.

6. The pump according to claim 5, wherein the pre-chopper has at least one axially projecting lug that is arranged eccentrically.

* * * * *